US005203634A

United States Patent [19]

Kim

[11] Patent Number: 5,203,634

[45] Date of Patent: Apr. 20, 1993

[54] DOUBLE GUIDE STRIP OPENING DEVICE

[76] Inventor: Myun H. Kim, 42-16 80th St., Apt. 6b, Elmhurst, N.Y. 11373

[21] Appl. No.: 959,168

[22] Filed: Oct. 9, 1992

Related U.S. Application Data

[63] Continuation of Ser. No. 763,928, Sep. 23, 1991, abandoned, which is a continuation-in-part of Ser. No. 538,129, Jun. 14, 1990, Pat. No. 5,054,618, and a continuation-in-part of Ser. No. 543,461, Jun. 25, 1990, Pat. No. 5,050,741, and a continuation-in-part of Ser. No. 695,205, May 3, 1991, abandoned.

[51] Int. Cl.[5] ..... B65D 33/00; B65D 27/34

[52] U.S. Cl. ..... 383/205; 229/238

[58] Field of Search ..... 383/200, 201, 202, 205, 383/206, 207, 208, 209; 229/206, 238, 239, 240, 309, 924, 926

[56] References Cited

U.S. PATENT DOCUMENTS

| | | | |
|---|---|---|---|
| 2,952,395 | 9/1960 | Spees | 383/205 |
| 3,127,087 | 3/1964 | Spees | 383/205 |
| 3,217,969 | 11/1965 | Schmit-Ohlhoff | 229/206 X |
| 3,266,965 | 8/1966 | Spees | 383/205 X |
| 3,446,632 | 5/1969 | Le Van | 383/205 X |
| 4,773,541 | 9/1988 | Riddell | 229/238 X |
| 4,877,139 | 10/1989 | Kim | 229/238 |
| 4,936,464 | 6/1990 | Kim | 229/239 X |
| 5,035,328 | 7/1991 | Kim | 229/238 |
| 5,035,329 | 7/1991 | Kim | 229/238 |
| 5,050,741 | 9/1991 | Kim | 229/238 X |

FOREIGN PATENT DOCUMENTS

| | | | |
|---|---|---|---|
| 0205559 | 8/1990 | Japan | 383/206 |
| 0258558 | 10/1990 | Japan | 383/205 |

*Primary Examiner*—Allan N. Shoap
*Assistant Examiner*—Jes F. Pascua
*Attorney, Agent, or Firm*—Schweitzer, Cornman & Gross

[57] ABSTRACT

A tear strip opening device for containers, packages, letters, etc. which comprises opposed, preferably mirror image guide strip structures, mounted externally and internally of the panel to be opened. Each of the structures is constructed to be tearable in a longitudinal direction along opposed lines of weakness, when the external and internal structures are mounted directly opposite to and longitudinally coextensive with each other. A strip section of the external structure forms a guide strip, while a strip section of the internal structure forms a tear strip. Typically, the external structure will form two spaced-apart guide strip elements, while a central section of the internal structure will form a single tear strip element cooperating with the spaced-apart external guide strip elements. The guide strip structures include materials which are relatively non-tearable, at least in the width direction, and which have either pre-defined lines of weakness or lines of weakness sufficiently numerous that their exact location is not important. A starting pull tab, formed at the ends of both internal and external structures, enables a longitudinally confined tear strip to be initiated. The subsequent tearing action is confined by edges of the external guide strip elements, whether pre-defined or defined at the time of starting to pull the tear strip. The use of mirror image elements is preferred, as it simplifies the manufacture of the openable container, by minimizing the materials required and facilitating their accurate alignment.

10 Claims, 5 Drawing Sheets

203
201
202
204
203
201
200
202

214
213
210
212
211
215

220
226
224
221
223
227
228
222
225
227
226

DOUBLE GUIDE STRIP OPENING DEVICE

RELATED APPLICATIONS

This application is a continuation of my copending parent application Ser. No. 763,928, filed Sep. 23, 1991. Said parent application was a continuation-in-part of my earlier applications Ser. No. 538,129, filed Jun. 14, 1990, now U.S. Pat. No. 5,054,618, Ser. No. 543,461, filed Jun. 25, 1990, Ser. No. 558,307, filed Jul. 25, 1990, now U.S. Pat. No. 5,050,741, and Ser. No. 695,205, filed May 3, 1991, the disclosures of which are hereby incorporated by reference.

BACKGROUND AND SUMMARY OF THE INVENTION

Much development work has been done in connection with the design of tear-opening features for cartons, envelopes, and other forms of packages and containers. Highly advantageous forms of such devices are described and claimed in the above-mentioned related applications. In general, known tear-opening structures have comprised guide strip means, formed of relatively non-tearable materials, secured on the outside surface of a panel to be opened. The guide strip means typically is formed with a guiding edge, which can be an edge of the guide strip or the longitudinally extending line of weakness formed in the guide strip material. In either case, the guide strip effectively forms a cutting edge against which the wall of the container can be cleanly torn. Frequently, the guide strip means is arranged to form two spaced-apart guide edges, so that a thin, longitudinally extending strip of wall panel material can be cleanly torn away during the opening process.

Tear-opening devices of known construction typically employ a tear strip element, secured to the internal surface of the panel to be opened and which is generally aligned with the guide strip means mounted on the outer surface of the panel. An end of the tear strip element is accessible, enabling it to be pulled outward relative to the container panel, causing the panel to be torn longitudinally by a shearing action between the guide strip means mounted on the outer surface and the tear strip means mounted on the inner surface of the panel.

A wide variety of devices have been proposed for defining the guide strip means provided on the outside of the container wall. The most elementary of these is a single strip of material, or a pair of spaced apart strips, formed of relatively non-tearable material and adhered to the outer surface of the container wall. A more advantageous form of guide strip arrangement may comprise a pair of spaced-apart guide strip elements mounted on a common carrier strip formed of tearable material. Such an arrangement is disclosed in the Kim U.S. Pat. No. 5,035,328. The carrier strip serves to support and space the guide strip elements and thus facilitates their mounting on the container wall. A guide strip arrangement may also be provided in which a relatively wide, composite guide strip structure is provided, which is tearable longitudinally in any one of a plurality of locations, while being highly resistant to tearing in the transverse direction. The longitudinal tearability of the structure may be provided by incorporating a substantial number of narrow, longitudinally extending elements, by utilizing available plastic materials having unidirectional tearing characteristics and/or by providing multiple longitudinally extending tear lines in otherwise relatively tear-resistant material. With guide strip structures of the type described, a tear strip of narrower width dimensions than the guide strip structure may be located anywhere between the edges of the structure. When the tear strip is drawn outwardly, guide strip edges are automatically formed by rupturing of the guide strip structure along longitudinal tear lines.

Although the structures described above are functionally advantageous and serve well to perform the container-opening functions for which they were designed, they can in some instances inconvenience the container manufacturing process, because of the need to use a variety of materials in forming the guide strip and tear strip elements, and the need for the exercise of care in the relative alignment of the guide strip materials, on the outside of the container wall, with the tear strip elements, on the inside of the container wall.

Pursuant to the present invention, a novel and improved arrangement is provided which significantly simplifies the process of manufacturing containers with tear strip opening devices without in any way compromising the performance of the tear-opening feature. Indeed, performance of the tear-opening feature is, if anything, enhanced. More specifically, the device of the invention incorporates a uniquely advantageous form of double guide strip construction in which separate guide strips are mounted directly opposite each other on the outside and inside surfaces of the container wall to be opened. Pursuant to the invention, the guide strip mounted on the outside surface of the panel effectively constitutes a guide edge-forming means, while the guide strip, mounted in directly opposing relation on the inside surface of the panel, constitutes a tear strip means. Two important advantages are derived from this arrangement: First, a similar (typically identical)—dual purpose guide strip serves both functions, of providing a guide edge-forming means and a tear strip means respectively on the outside and inside surfaces of the panel. Thus, a single component can serve both purposes, whereas with conventional structures, one type of material serves to provide a guide strip means, and a different type of material provides a tear strip means. A second significant advantage to be derived from the invention is the facility of accurately aligning the guide edge means, on the outside surface of the panel, with the tear strip means, on the inside surface.

The device of the invention accommodates a wide variety of guide strip constructions structures which, when mounted on opposed surfaces of a container panel, provide a uniquely advantageous double strip opening device.

For a more complete understanding of the above and other features and advantages of the invention, reference should be made to the following detailed description of preferred embodiments of the invention, and to the accompanying drawing.

DESCRIPTION OF PREFERRED EMBODIMENTS

Figure 1:
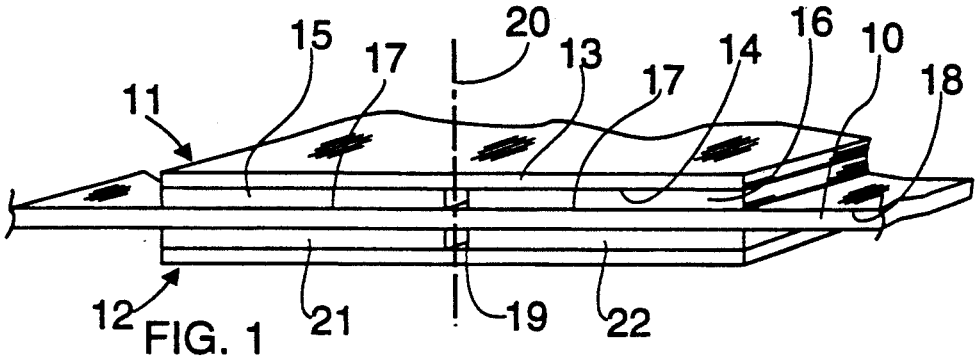
FIGS. 1–12 are enlarged, fragmentary cross-sectional perspective representations of various forms of double guide strip opening devices constructed in accordance with the principles of the invention.

Referring now to the drawing, and initially to FIG. 1 thereof, the reference numeral 10 designates generally a section of container panel, which is to be severed by the tear-opening feature of the invention. The panel 10 can be of any appropriate material. For corrugated cartons, the panel 10 will be formed of corrugated board. For folding cartons, the panel typically will be formed of a relatively thin fiberboard material, Kraft paper, plastic and/or metal foil. For envelopes and the like, the panel 10 may be formed of paper. The form of tear-opening device shown in FIG. 1 comprises a structure of mirror image guide strip assemblies 11, 12, mounted on opposite sides of the panel 10. As will be understood, the guide strip assemblies 11, 12 are in elongated strip form, being provided substantially in continuous lengths, as from a large roll, for example. In the illustration of FIG. 1, the assembly 11 includes a carrier strip 13, which is formed of a material which is easily tearable at least in the longitudinal direction. Paper, thin plastic, thin metal foil, or other readily tearable materials are suitable for the carrier strip. Adhesively or otherwise bonded to the inner surface 14 of the carrier strip 13, are continuous, longitudinally extending strips 15, 16. The latter strips are formed of a material which is relatively non-tearable at least on the width direction. Suitable materials are certain plastics such as polyvinyl chloride or polyethylene, reinforced paper, certain metal foils, fiberglass reinforced materials, and the like. The exposed surfaces 17 of the guide strips 15, 16 are adhesively or otherwise bonded to the outer surface 18 of the container panel 10. As shown in the cross-sectional view of FIG. 1, there is a slight gap 19 formed between the adjacent inner edges of the respective strips 15, 16, forming a natural, longitudinally extending tear line along the composite strip 11.

In the illustration of FIG. 1, the composite guide strip 12, mounted on the internal surface of the panel 10, strip 12 is constructed identically to the guide strip 11, and is mounted directly opposite to and longitudinally coextensive with the outer guide strip 11, in mirror image fashion.

For bonding of the guide strips to the container panel 10, it is usually desireable to supply wet or pressure sensitive adhesives, applied to the surface(s) of the guide strips which contact the panel 10. Heat sealing procedures may also be employed if desired.

The panel 10 may be torn open along a tear line axis 20 by gripping an end portion of one of the longitudinally extending plastic strips 21, 22 of the internal guide strip 12. Pursuant to the invention, although the inner and outer guide strips can be identical construction, the inner guide strip (for example, guide strip 22) forms a tear strip element, while the cooperating outer guide strip (strip element 15 in this case) functions to provide a guide edge. The opening function of the structure is, of course, well known. The novelty and its attendant advantages are derived in large part from the fact that the inside and outside guide strips are mirror images.

Figure 2:
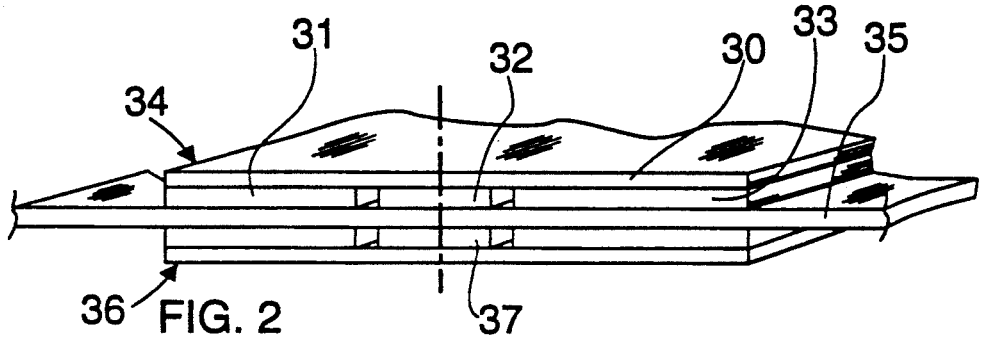

In the modification of FIG. 2, a dual composite strip comprises a continuous, longitudinally extending carrier strip 30, formed of paper or other suitable tearable material. Adhesively or otherwise bonded to the inner surface of the carrier strip are continuous, longitudinally extending strip-like elements 31, 32 and 33 of plastic or other relatively non-tearable material. The composite guide strip identified generally by the reference numeral 34 is mounted on the external surface of the container opening panel 35, and a mirror image duplicate guide strip 36 is mounted on the inside surface of the panel. In the arrangement of FIG. 2, the center element 37 of the internal guide strip functions as a tear strip element, in cooperation with spaced-apart guide strip elements 31, 33 of the external guide strip 34.

Figure 3:
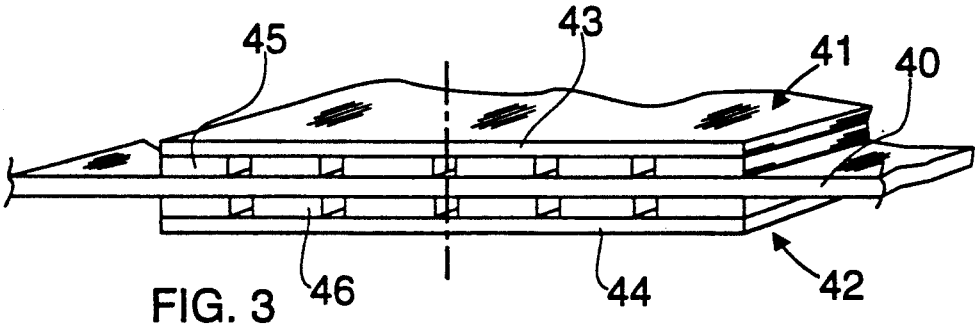

In the embodiment of FIG. 3, a container opening panel 40 is provided with a structure formed of outer and inner mirror image composite guide strips 41, 42, each comprising a continuous, longitudinally extending carrier strip 43, 44, formed of tearable material and mounting, in this illustration, six continuous, longitudinally extending strip elements 45, 46, formed of relatively non-tearable material. In the structure illustrated in FIG. 3, a tear strip function may be formed by any one or more of the internal strip elements 46 cooperating with a straddling pair of strip elements 45, carried by the external guide strip 41. In the arrangement of FIG. 3, the position of the tear strip element(s) need not be symmetrical with respect to the longitudinal center line of the composite guide strips 41, 42, but can be offset to one side.

Figure 4:
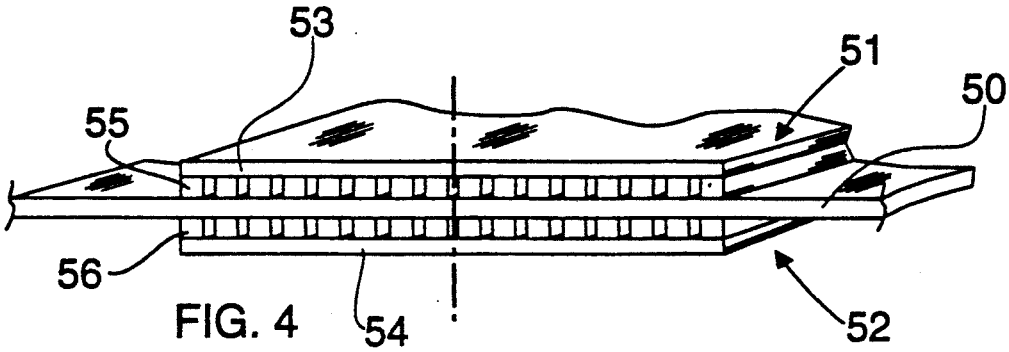

In the modification of FIG. 4, a container panel 50 is provided externally and internally with dual, mirror image composite guide strips 51, 52, each comprising a carrier strip 53, 54 and multiple, longitudinally coextensive strips 55, 56 of relatively non-tearable material. The function and performance of the modification of FIG. 4 is substantially similar to that of FIG. 3. Typically, the double guide strip structure of either FIG. 3 or FIG. 4 will be provided at one end with short slots or notches (not shown), defining the start of a tear strip. The slotted end can be conveniently gripped and pulled outward, causing the tear strip structure and panel to be severed longitudinally along defined spaces between the elements 55 of the external guide strip. In this respect, a tear strip element may be formed by one, or more than one, of the internal strip elements 56, and the location of the tear strip-forming element(s) 56 can be symmetrical or asymmetrical with respect to the longitudinal axis of the guide strip 51, 52, as will be readily understood.

Figure 5:
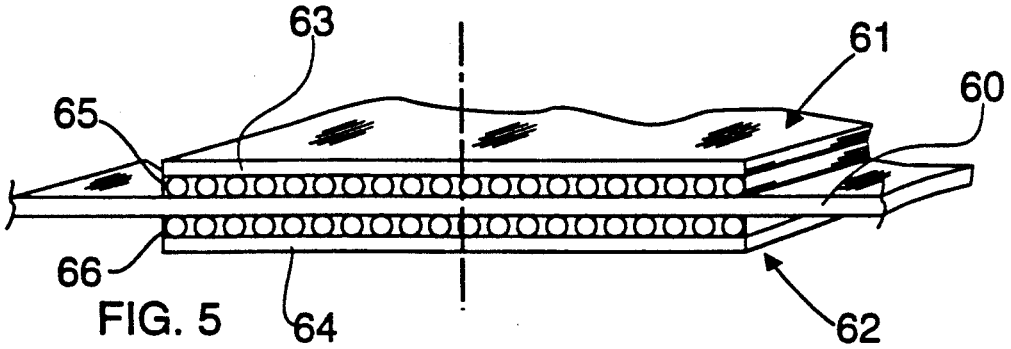

The modification of FIG. 5, a container opening panel 60, is provided with a structure including external and internal composite guide strips 61, 62, each comprising a carrier strip 63, 64, carrying a large plurality of longitudinally extending stringlike elements 65, 66. The string-like elements typically can be fiberglass elements, or yarns formed of fiberglass elements, elements of strong monofilament or multifilament plastic or the like.

The arrangement, in any case, is such that effectively continuous, longitudinally extending tear lines are formed between adjacent elements 65 and 66. By notching, slotting or otherwise constructing one end of the structure, one or more tear strip tabs (not shown) are formed. When pulled outwardly, the tearing will continue along the lines established, as confined by a particular set of string-like elements 65, of the external guide strip 61, cooperating with a particular set of string-like elements 66, of the internal guide strip 62.

Figure 6:
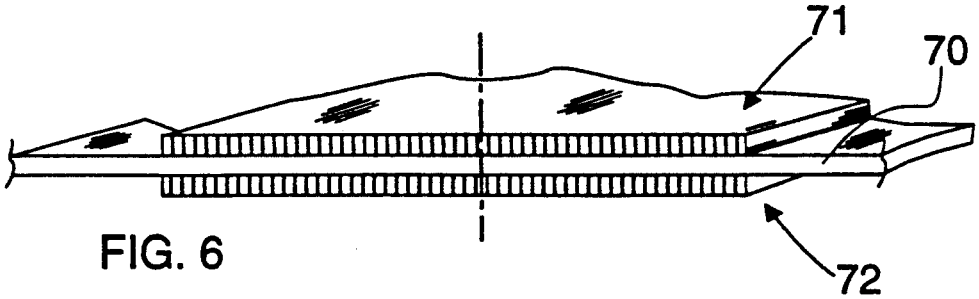

In the modification of FIG. 6, a container panel 70 is provided with dual guide strips 71, 72 on its external and internal surfaces respectively. The opposed guide strips 71, 72 are each formed of a continuous strip of generally homogenous plastic material, which may incorporate unidirectionally oriented reinforcing fibers and which is extruded or otherwise formed in a manner to provide highly unidirectional tearing characteristics. Such materials are well known in the art and do not, in themselves, form any part of the invention. Pursuant to the present invention, a structure is comprised of continuous, longitudinally extending guide strips 71, 72 of such materials, oriented to accommodate longitudinal tearing. The guide strips are bonded to the external and internal surfaces of the container panel. The guide strips 71, 72 preferably are notched or slotted for a short distance at one end to define a tear strip tab (not shown). When such a tab is pulled outwardly, the structure tears continuously and longitudinally along spaced-apart tear lines predefined by the location of the initial cuts or slots.

Figure 7:
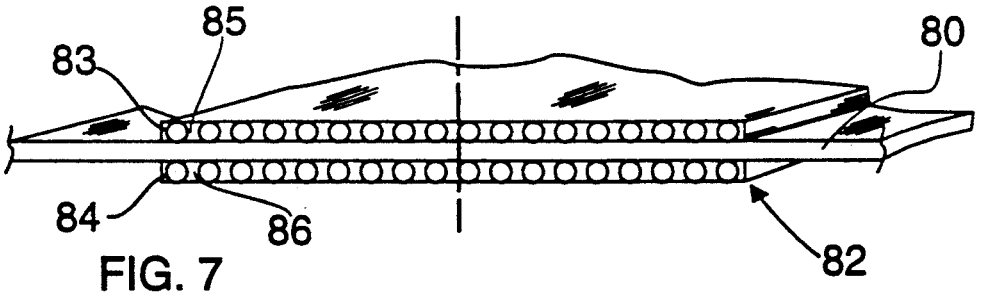

In the modification of FIG. 7, a container panel 80 is provided on its opposite surfaces with dual guide strips 81, 82. The guide strips 81, 82 are comprised of a large plurality of continuous, longitudinally extending linear elements, which may be yarns or fibers of fiberglass or strong plastic arranged in side by side fashion in a matrix 85, 86 of a suitable tearable plastic or other material. The arrangement is such that effective longitudinally extending tear lines are formed between adjacent pairs of longitudinal elements 83, on the external guide strip, and adjacent elements 84 on the internal guide strip. A tear strip/guide strip arrangement is formed by initiating a starting tab (not shown) at one end of the structure, enabling the defined, longitudinally extending strip of material to be removed from the container panel 80.

Figure 8:
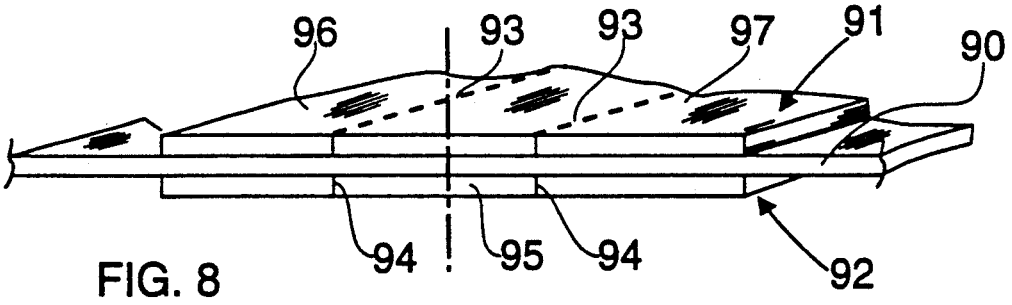

In the modification of FIG. 8, a container panel 90 is provided with opposed, mirror image guide strips 91, 92 on its external and internal surfaces. The FIG. 8 modification, the guide strips are continuous strips of a suitable relatively non-tearable plastic or other material provided with spaced-apart, longitudinally extending lines of weakness 93, 94 which form longitudinally extending tear lines. When the dual guide strips are mounted in mirror image fashion on the container wall 90 to form a structure, the respective lines of perforation 93, 94 are aligned directly opposite each other, and serve to define a removable tear strip section. The center section 95 of the internal guide strip cooperates with the spaced-apart outer strip elements 96, 97 of the outer guide strip, to form a tear strip/guide strip arrangement for removing a defined strip section from the panel 90.

Figure 9:
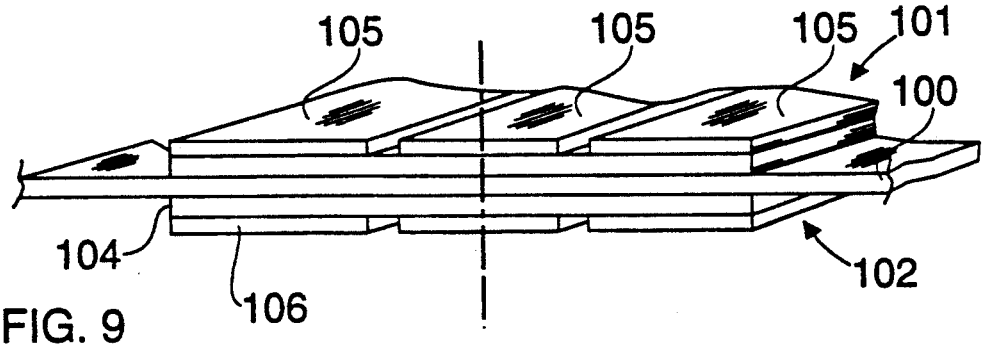

In the modification of FIG. 9, a container panel 100 is provided with dual composite guide strips corresponding substantially to those shown in FIG. 2, but mounted on the panel surfaces in inverted orientation relative to that of FIG. 2. Thus, the composite guide strips 101, 102 each comprise a carrier strip 103, 104 of relatively tearable material, and each mounts a series of three strip-like elements 105, 106 of material relatively non-tearable in a widthwise direction. In the modification of FIG. 9, the relatively non-tearable, longitudinally extending elements 105, 106 are bonded to the container panel 100 through the relatively thin, longitudinally tearable carrier strips 103, 104. The opening function is basically the same, however, as that of the modification of FIG. 2.

Figure 10:
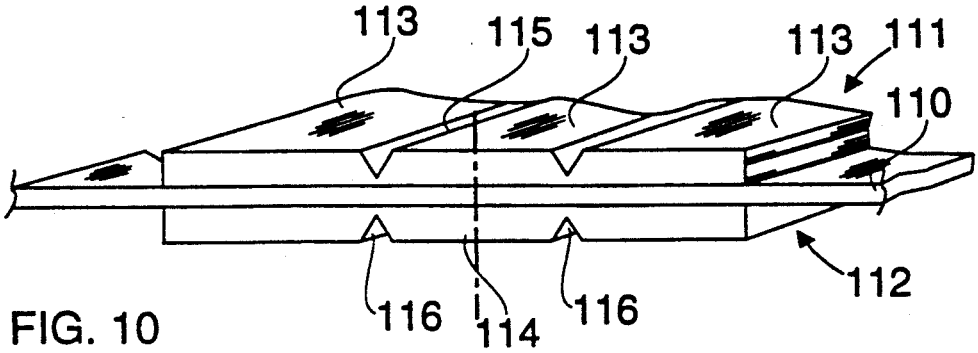

In the modification of FIG. 10, a container panel 110 is provided with a structure of continuous, longitudinally extending guide strips 111, 112, each comprising a single strip of relatively non-tearable plastic material. In the illustrated arrangement, three strip-like elements 113, 114 of the respective guide strips 111, 112 are formed by continuous, longitudinally extending lines of weakness, for example deep V-shaped grooves 115, 116. The V-shaped grooves 115, 116 extend sufficiently deep into the body of the plastic material so as to form effective tear lines weakness, extending continuously longitudinally throughout the length of the guide strip. At one end, the structure can be slotted or notched in alignment with the respective tear lines 115, 116, to form a starting pull tab (not shown). It will be understood, of course, that the grooves 115, 116 may be formed on opposite sides of each of the guide strips 111, 112, to extend toward the center, if desired. Such an arrangement is disclosed in my co-pending application Ser. No. 543,461.

Figure 11:
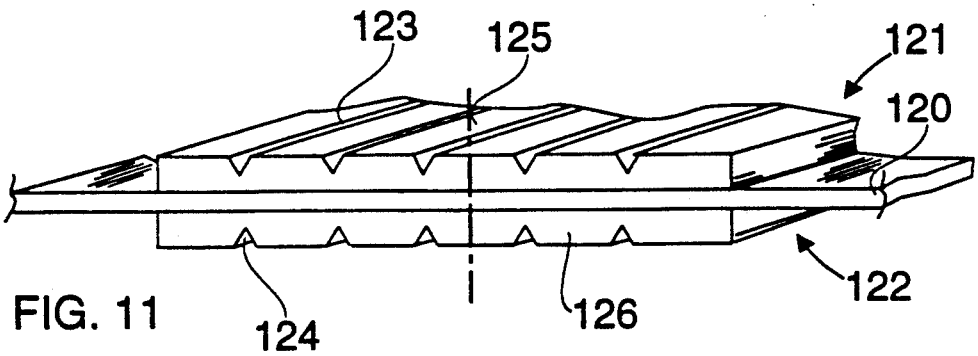

The modification of FIG. 11 is similar to that of FIG. 10, except that the double guide strips are subdivided into six strip-like elements, instead of three. A container panel 120 has a structure comprising guide strips 121, 122 of mirror image constructions mounted on its respective external and internal surfaces. A series of deep V-shaped grooves 123, 124 divide the respective guide strips into a plurality of continuous, longitudinally extending strip-like elements 125, 126. The guide strips 121, 122 are formed of a suitable, relatively non-tearable plastic material, with the V-shaped grooves 123, 124 forming longitudinally extending tear lines along which the guide strips may be torn. Any one or more of the strip-like elements 125, 126 may define the tear element, typically, two or more of the strip-like sections, intermediate the edge extremities, will define a tear-away strip section. Typically, the tear strip section is defined by initial cuts or notches (not shown) at one end of the structure, which starts the tear along down a particular set of grooves.

Figure 12:
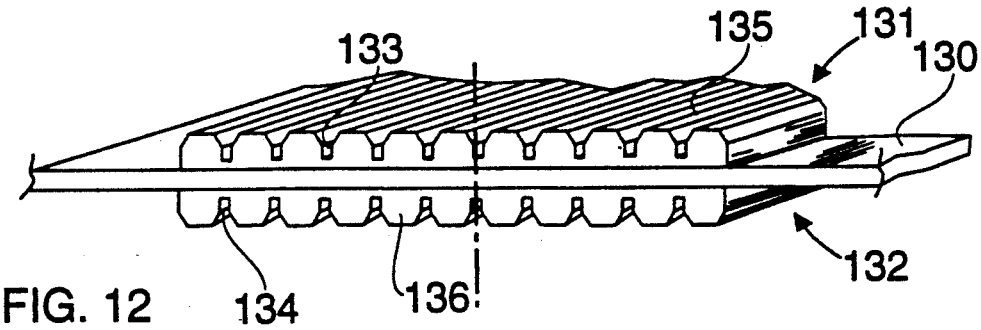

In the modification in FIG. 12, a container panel 130 is provided with dual guide strips 131, 132 on its opposite surfaces, each formed of a relatively non-tearable plastic material formed in a "corduroy" configuration with multiple, closely spaced grooves 133, 134, forming continuous, longitudinally extending tear lines and effectively subdividing the otherwise intact guide strips into a plurality of narrow, elongated strip-like elements 135, 136. By notching the structure at one end, as heretofore described, a pull strip section (not shown) is defined by an opposed spaced pair of the grooves 133, 134. When the start tab is pulled outwardly, a tear strip section is confined longitudinally by the predefined pair of grooves 133, 134, such that a well-defined tear strip is formed by progressively pulling the tear strip section from one end.

Figure 13:
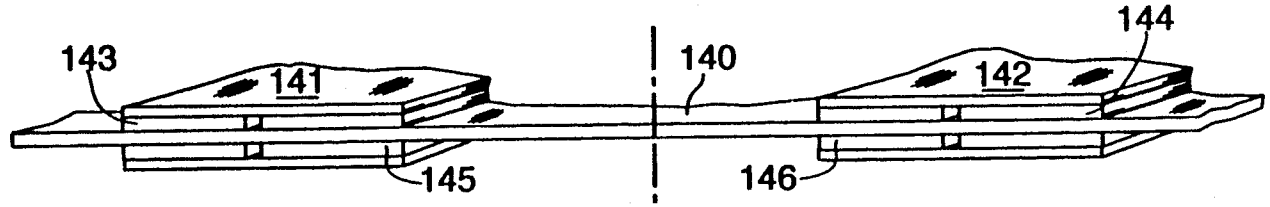
FIGS. 13–16 are enlarged fragmentary cross-sectional perspective representations of wide tear strip devices utilizing spaced apart pairs of double guide strip structures according to the invention.

In FIGS. 13–16 there are shown several examples of wide tear strip constructions, for example of the type disclosed in Kim U.S. Pat. No. 5,050,741, formed using dual guide strip arrangements as previously described. In FIG. 13, a container panel 140 is provided with spaced-apart dual guide strip structures 141, 142. Each of the dual guide strip structures is constructed in the manner of FIG. 1. When opening the device of FIG. 13, the outer non-tearable strip sections 143, 144 of the external guide strips serve respectively to form widely-spaced guide strip edges. These guide strip edges cooperate with strip elements 145, 146 of the internal guide strips, which function in the capacity of widely-spaced tear strips. A wide section of the panel 140 is removed during the tear-open procedure.

Figure 14:
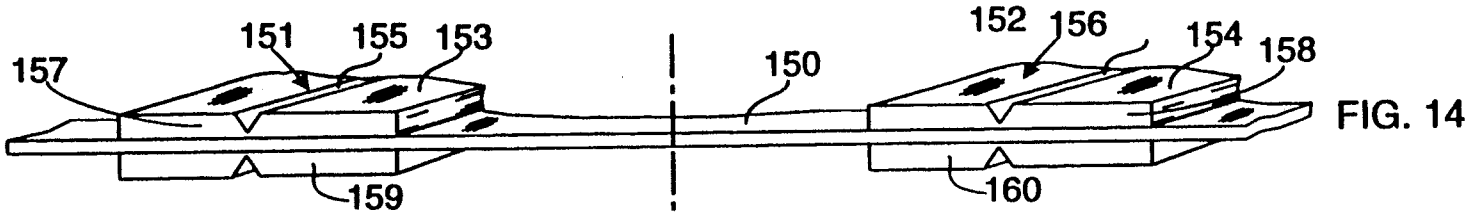

In the modification of FIG. 14, a container panel 150 is provided with widely-spaced sets of guide strip structures 151, 152. Each of these structures comprises external and internal longitudinally extending guide strips 153, 154 of relatively non-tearable plastic material, each provided with a continuous, longitudinally extending line of weakness, for example a deep V-groove 155, 156, forming a tear line. Mirror image strips are formed on the internal and external surfaces of the container panel, as shown. The opening function of the FIG. 14 modification is substantially the same as that of the modification in FIG. 13, with external outer strip sections 157, 158 forming widely-spaced guide strip edges for cooperation with internal, widely-spaced tear strip sections 159, 160.

Figure 15:
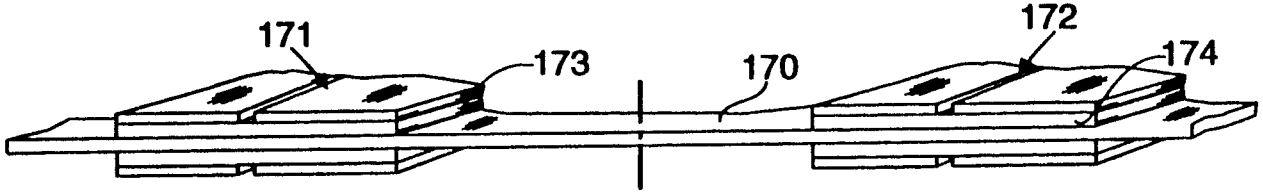

The modification of FIG. 15 is closely similar to that of FIG. 13. A container panel 170 is provided with spaced-apart dual guide strip structures 171, 172. The individual dual guide strip structures are constructed in the same manner as in FIG. 13, except that the carrier strip elements, 173, 174 are mounted directly on the surfaces of the container 170, in the manner of the modification of FIG. 9. The opening function of the FIG. 15 modification is the same as that of FIGS. 13 and 14.

Figure 16:
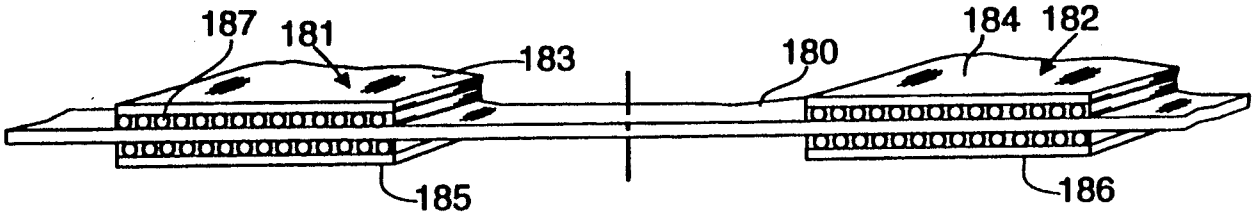

In the modification of FIG. 16, a container panel 180 is provided with spaced-apart dual guide strip structures 181, 182, each comprising guide strips of the type shown in FIG. 5. Carrier strips 183–186, of material which is relatively tearable, mount a series of closely spaced, longitudinally extending elements 187 of a material which is relatively non-tearable, typically elements or yarns of fiberglass or strong plastic. In each of the widely-spaced guide strip structures 181, 182, longitudinally confined tear lines may be formed between any two adjacent pairs of the longitudinally extending elements 187, above and below the container panel. The operation of the structures is essentially the same as that of FIG. 5.

Figures 17, 18, 19, 20, 21:
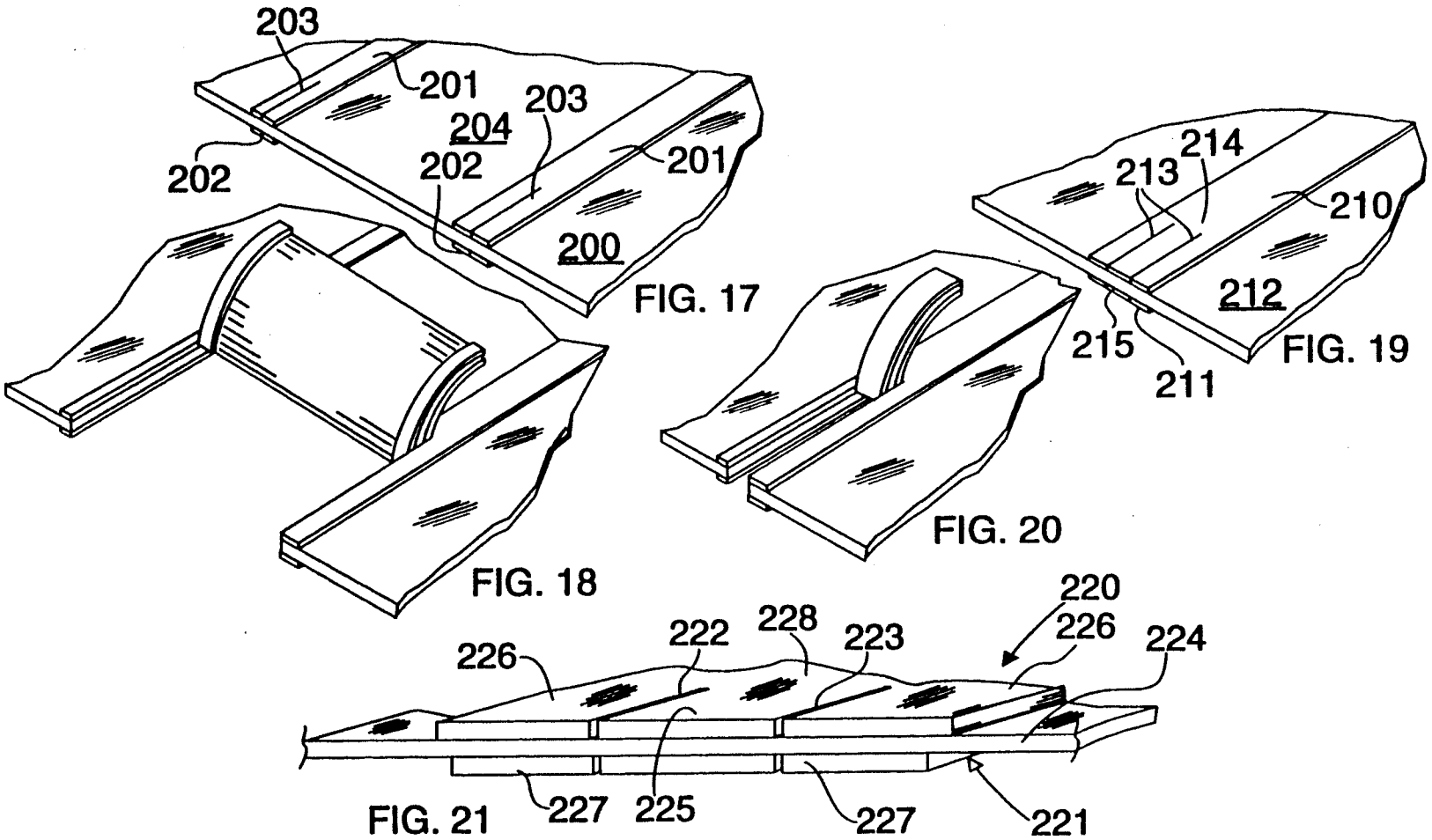
FIG. 17 is a fragmentary perspective view illustrating a wide tear strip opening feature generally in accordance with the constructions of FIGS. 13 or 16.
FIG. 18 is a fragmentary perspective view, showing the wide opening feature of FIG. 17 after partial opening.
FIG. 19 is a fragmentary perspective view illustrating an opening device according to the invention, in which mirror image guide strips are used to form a single tear-open strip.
FIG. 20 is a perspective view, similar to FIG. 19, showing the structure of FIG. 19 after partial opening.
FIG. 21 is a fragmentary perspective view of a further modified form of the invention, for use particularly where the external and internal guide strips have multiple tear lines.

FIGS. 17 and 18 illustrate a wide strip opening device for a container 200. Upper and lower opposed guide strips 201, 202 are provided on the panel 200, spaced apart a considerable distance and extending longitudinally over the full length of the panel to be opened. At one end edge of the container panel 200, the guide strips 201, 202 and the container wall itself are provided with a longitudinally extending starting slot or cut 203, which extends from the edge of the carton a short distance longitudinally along the guide strip structures. The slots 203 may be formed at the time of the manufacture of the container, if desired, or may be formed at the time of opening of the container, if greater security is desired.

As shown in FIG. 18, the end of the tear strip section 204, located between the slots 203, forms a wide tear strip, which may be gripped at the end and pulled outward of the carton. Once started along the longitudinal lines of the slots 203, the tear will continue along those lines for the full length of the guide strips 201, 202.

As will be understood, in any of the forms of opening devices shown in FIGS. 1–16, where the tear lines are well-defined, it is advantageous to align the slots 203 with such predefined tear lines. In structures such as shown in FIGS. 5–7, 12 and 16, the starting slots may be established virtually anywhere between the edge extremities of the dual strip assemblies.

In the illustration of FIGS. 19 and 20, a dual guide strip opening device generally of a type shown in FIGS. 2–12 is formed by mounting of structures of opposed guide strips 210, 211, one directly opposite the other, extending over the full length of a container panel 212 to be opened. Starting slots 213 are provided at one end, either at the time of container manufacture or later, as desired, to form a starting pull tab 214. As described in connection with FIGS. 17 and 18, the starting slots 213 are aligned with predefined tear lines, if any. Where the tear lines are sufficiently numerous, alignment of the starting slots 213 is not significant. If desired, the starting slots 213 may be disposed at an angle, diverging to the free edge 215 of the starting tab. In that manner, the starting slots can be arranged to intersect with predefined, longitudinally extending tear lines, even if not precisely aligned therewith in the first instance.

Although the optimum embodiment of the invention utilizes structures of identical guide strips externally and internally of the container panel to be opened, where the strip structure is of a type providing a multiplicity of possible tear lines, for example with structures of the type shown in FIGS. 3–7, 11 and 12, the external and internal strips may be of different width and possibly even of different construction. Such an arrangement is shown in FIG. 21, in which guide strips of the type illustrated in FIG. 6 are employed.

As is clear in FIG. 21, the external guide strip 220 is wider than the internal guide strip 221. The material of the guide strips is unidirectionally fiber reinforced, so as to be relatively tearable in the longitudinal direction and relatively non-tearable in the width direction. Spaced-apart starting slots 222, 223 are formed in the strips and in the intervening section of container wall 224 to define a starting pull tab 225. Pursuant to the invention, the starting slots are located inside the side edges of the narrower of the two guide strips, so that strip margins 226, 227 are formed on each lateral side of a central, tear-away strip section 228.

In the embodiment of FIG. 21, the longitudinal tear lines defining the tear strip section 228 are defined by the positions of the starting slots 222, 223. Where the guide strip construction is as shown in FIG. 6, the tear lines can be located virtually anywhere within the edge extremities of the narrower strip 221. With strip materials such as shown in FIG. 12, the starting slots are aligned with or arranged to intersect with pre-defined tear lines, which will define the tear strip section.

In any of its various modifications, only some of which are illustrated herein, the structure of the invention enables important advantages to be realized in the manufacture and utilization of tear-opening features for containers of all types (the term "container" being used in a generic sense to include boxes, envelopes, drums, flexible packages and the like). In a particularly advantageous form of the invention, opposed guide strips are mirror images, as the identical guide strips are used both externally and internally of the openable container panel. This enables the container manufacturer to install advantageous forms of tear-opening structures using only a single component. The individual guide strips, whether of composite construction or of a single material, can be provided in a continuous roll, and both openable surfaces of the container panel can be provided with the same guide strip construction, either from a common roll supply or from a plurality of rolls of the same material. In either case, rather significant economies and conveniences are provided at the manufacturing stage. Inasmuch as the external and internal guide strips are the same, proper alignment of the materials during application is simplified. Moreover, proper alignment (or not) is easily and quickly ascertained by visual inspection, since both the external and internal strips should be installed in mirror image fashion.

It should be understood, of course, that the specific forms of the invention herein illustrated and described are intended to be representative only, as certain changes may be made therein without departing from the clear teachings of the disclosure. Accordingly, reference should be made to the following claims in determining the full scope of the invention. In the claims, wherever the context permits, reference to "tearable" materials shall mean materials that are relatively easily tearable at least in the longitudinal direction, and reference to "non-tearable" materials shall mean materials that are relatively difficult to tear, at least in the widthwise direction.

I claim:

1. A double guide strip opening device for a container wall, which comprises (a) said container wall having at least one structure comprised of inner and outer elongated guide strips mounted respectively on internal and external surfaces of said container wall, in generally opposed, at least partially overlapping relation to each other, and extending along a line to be torn, (b) each of said guide strips having opposite side edges and formed to be relatively non-tearable in the width direction and relatively more tearable in the longitudinal direction, (c) each of said guide strips forming one or more longitudinally extending tear lines intermediate its side edges, (d) tear lines of the inner and outer guide strips of said at least one structure being generally aligned in opposed relation in spaced-apart locations to define a tear strip section which is removable along said tear lines, (e) said tear strip section, when pulled outward with respect to said container wall, being severed from said guide strips along with a section of said container wall, (f) the remaining portions of said at least one structure, after severing of said tear strip section, forming spaced-apart guide strip edges.

2. An opening device according to claim 1, further characterized by, (a) one guide strip being mounted externally and one guide strip mounted internally on said container wall, in opposed relation, .

(b) each of said strips forming spaced-apart tear lines, (c) a strip section of each of said opposed guide strips being defined by spaced apart tear lines therein forming a tear strip section severable from the body of said at least one structure by outward pulling on an end of said strip section.

3. An opening device according to claim 1, further characterized by, (a) said device including spaced-apart individual structures of said guide strips arranged in two opposed pairs, (b) each of said spaced-apart individual structures defining at least one tear line, (c) said spaced-apart individual structures of guide strips defining a tear-out section of said container wall between and of greater width than the respective individual structures.

4. An opening device according to claim 1, further characterized by, (a) said spaced-apart tear lines being pre-defined by spaced-apart cuts of limited length provided in an end portion of said at least one structure and forming a separable pull tab therein.

5. An opening device according to claim 1, further characterized by, (a) said guide strips each comprising a plurality of longitudinally extending, relatively non-tearable elements mounted on a relatively more tearable carrier strip.

6. An opening device according to claim 1, further characterized by, (a) said tear lines being formed by providing longitudinally extending lines of weakness in said guide strips.

7. An opening device according to claim 1, further characterized by, (a) said guide strips being formed, at least in part, by a generally homogeneous material which is oriented to be relatively tearable in a longitudinal direction and relatively less tearable in a transverse direction.

8. An opening device according to claim 1, further characterized by, (a) said guide strips being formed by a plurality of separate, longitudinally extending elements of relatively non-tearable material.

9. An opening device according to claim 8, further characterized by, (a) said guide strips each comprising at least three longitudinally extending strip-like elements defining said spaced-apart tear lines.

10. An opening device according to claim 1, further characterized by, (a) said guide strips each comprising a plurality of longitudinally extending elements of relatively non-tearable material laid in side-by-side relation, and (b) a relatively more easily tearable material forming a matrix for said longitudinally extending elements.

* * * * *